US005803587A

United States Patent [19]

Chen

[11] Patent Number: 5,803,587

[45] Date of Patent: Sep. 8, 1998

[54] CANDLE LANTERN

[76] Inventor: Chin S. Chen, 3126 Lexington Dr., Ann Arbor, Mich. 48105

[21] Appl. No.: 900,657

[22] Filed: Jul. 25, 1997

[51] Int. Cl.[6] ..... F21L 19/00

[52] U.S. Cl. ..... 362/161; 362/181; 362/316

[58] Field of Search ..... 362/161, 162, 362/180, 181, 182, 312, 315, 316

[56] References Cited

U.S. PATENT DOCUMENTS

| | | | |
|---|---|---|---|
| Re. 20,434 | 7/1937 | Barrett, Jr. | 67/21 |
| 214,394 | 4/1879 | Irwin . | |
| D. 243,971 | 4/1977 | Thompson | D48/2 |
| D. 288,722 | 3/1987 | Harada | D26/11 |
| D. 321,261 | 10/1991 | Shiraishi | D26/11 |
| 568,533 | 9/1896 | Hirsch . | |
| 1,183,656 | 5/1916 | Lindsey . | |
| 1,196,913 | 9/1916 | Weidlich . | |
| 1,309,893 | 7/1919 | Johnson | 361/161 |
| 2,685,023 | 7/1954 | Valle | 240/13 |
| 2,935,041 | 5/1960 | Rovere | 116/132 |
| 3,760,177 | 9/1973 | Levy | 240/81 |
| 4,186,430 | 1/1980 | Britton | 362/162 |
| 4,260,365 | 4/1981 | Kayne | 431/291 |
| 4,566,055 | 1/1986 | Klees et al. | 362/162 |
| 4,781,895 | 11/1988 | Spector | 422/125 |
| 4,787,017 | 11/1988 | Vrettos | 362/161 |
| 4,797,090 | 1/1989 | Rogers | 431/290 |
| 4,907,140 | 3/1990 | Overstreet | 362/162 |
| 4,926,297 | 5/1990 | Masters et al. | 362/162 |
| 5,424,928 | 6/1995 | Jordan et al. | 362/162 |

*Primary Examiner*—Stephen F. Husar
*Attorney, Agent, or Firm*—Young & Basile, P.C.

[57] ABSTRACT

A candle lantern equally suitable for indoor and outdoor use, and which further doubles as a decorative candle holder, comprising a body made from a tube of translucent material, for example glass or plastic, and two interchangeable candle-holding cups/heat shields mounted in the upper and lower ends of the tube, respectively, by set screws extending through holes in the tube. A base comprising a set of wire legs is preferably provided at the lower end of the tube, secured to the tube by the lower set of set screws, while a retractable bail handle and optional rain shield are provided in the upper end of the tube and secured to the upper set screw structure. In a preferred form the candle-holding cups include both blind apertures for receiving the set screws against the outer surface of the cup, and a set of holes for allowing the set screws through the cup to engage undersized candles.

12 Claims, 3 Drawing Sheets

FIG-2
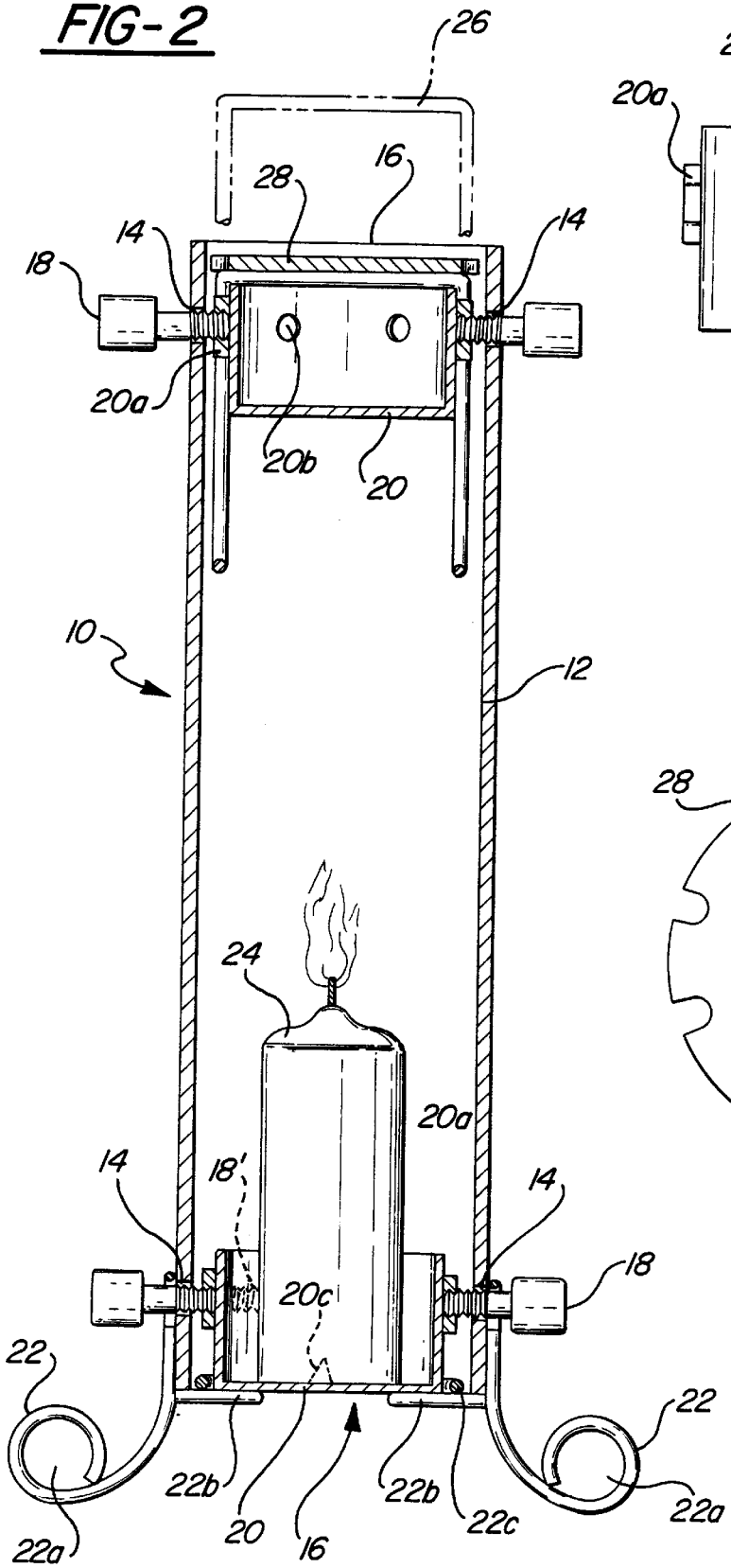
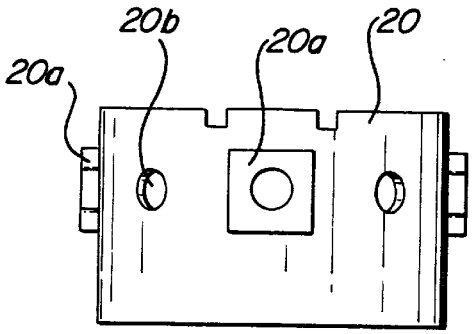
FIG-3
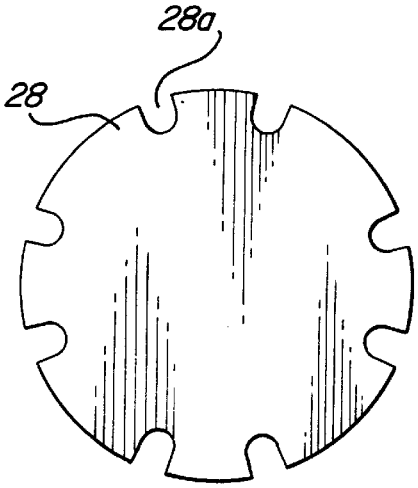
FIG-4

CANDLE LANTERN

FIELD OF THE INVENTION

The present invention is in the field of candle lanterns.

DESCRIPTION OF PRIOR ART

Candles have been known and used for centuries to provide elegantly simple and inexpensive light. However, candles suffer the disadvantage of being blown out by air currents and of presenting an exposed flame hazard.

Over the years many types of candle lantern have been proposed to house and protect the candle flame. There generally seem to be two types of candle lantern: indoor lanterns with elaborate stands and hanging structure, and outdoor "backpacking" lanterns which are small, lightweight and which have compact cylindrical bodies and folding handles.

Examples of patents with lanterns of the above-described "indoor" type include U.S. Pat. No. Re. 20,434 to F. J. Barrett, Jr.; U.S. Pat. No. 2,685,023 to Valle; U.S. Pat. No. 2,935,041 to Rovere; U.S. Pat. No. 4,260,365 to Cayne; and, U.S. Design Pat. No. 243,971 to Thompson. Examples of patents for the above-described "outdoor" type include U.S. Pat. No. 4,186,430 to Britton; U.S. Pat. No. 4,566,055 to Klees et al; U.S. Pat. No. 4,926,297 to Masters et al; U.S. Pat. No. 5,424,928 to Jordan et al; U.S. Design Pat. No. 321,261 to Shiraishi; and U.S. Design Pat. No. 288,722 to Harada.

In general, the "indoor" lanterns are too heavy, too unstable and insufficiently weatherproof for outdoor use, especially camping use. The "outdoor" lanterns are typically not elegant enough for indoor use; are generally designed to be hung from a tent line, not stood upright on a table; and tend to minimize light-emitting glass to protect them from damage in the field.

SUMMARY OF THE INVENTION

Accordingly, it is a primary object of this invention to provide a candle lantern that is aesthetically pleasing, cost effective and lightweight.

It is a further object of this invention to provide a candle lantern that is suitable for indoor use and yet is rugged, stable and compact enough for outdoor use.

It is a further object of this invention to provide a candle lantern with multipurpose, interchangeable components to minimize the number of different parts and to optionally allow use of the lantern as a candle stand.

In general, the above objects are achieved with a lantern comprising a unitary chimney/body made from an open-ended tube of translucent or transparent glass or plastic; a removable lower candle holder, and preferably an interchangeable upper candle holder; and set screw type candle holder locking structure which serves at either end of the lantern as support for a stand-up base or a hanging bail.

In a preferred form, the stand-up base structure for the candle is reversible for use as a hanging bail.

Further objects and advantages of my invention will become apparent upon a consideration of the drawings and following description.

BRIEF DESCRIPTION OF THE DRAWINGS

FIG. 2 is a cutaway side elevational view of the candle lantern of FIG. 1;

FIG. 3 is a side elevational view of the interchangeable candle holder/heat shield structure of FIG. 2;

FIG. 4 is a top plan view of an optional rain shield for the upper end of the lantern of FIG. 2; and, FIGS. 5 and 6 are top and bottom views, respectively, of the candle lantern of FIG. 1.

DETAILED DESCRIPTION OF THE DRAWINGS

Figure 1:
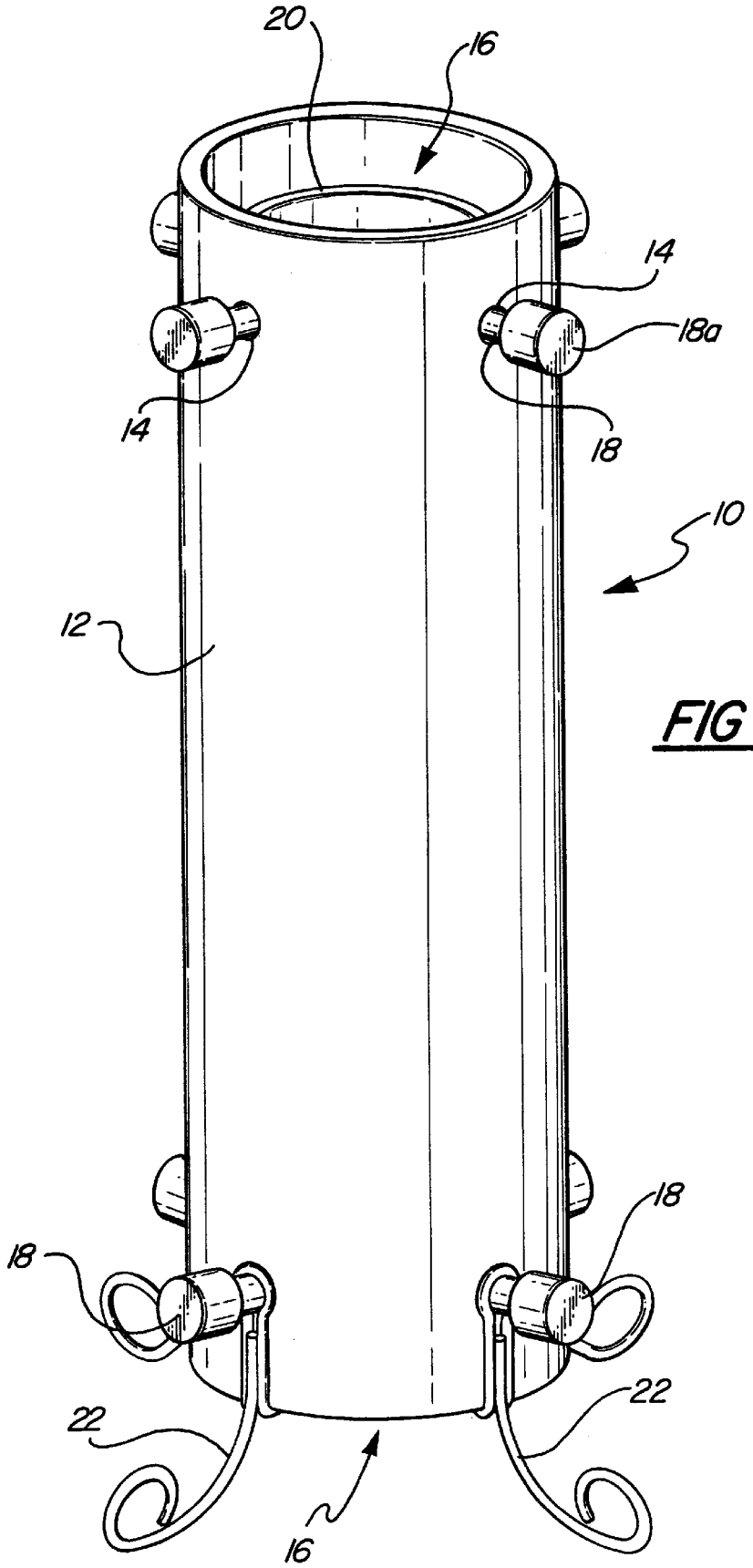
FIG. 1 is a perspective view of a candle lantern according to the present invention.
Figure 5:
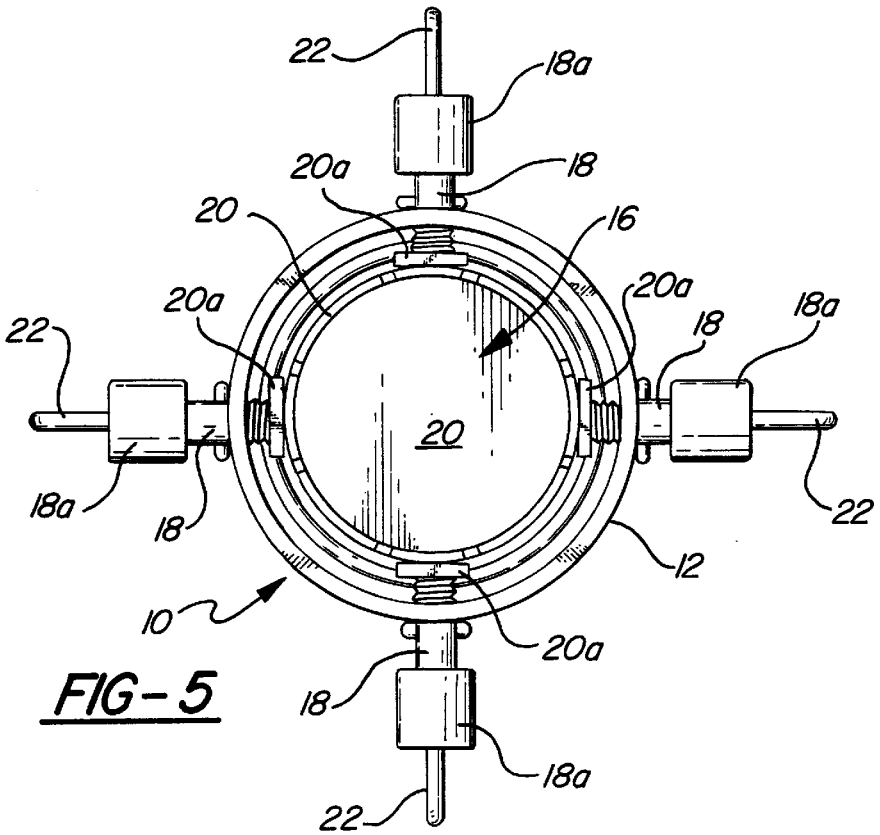

Referring first to FIG. 1, a preferred embodiment of the candle lantern according to the present invention is indicated generally by reference numeral 10. Candle lantern 10 is illustrated in FIG. 1 as an upright, free standing lantern which can be placed on any reasonably level surface; it works equally well as a hanging lantern as will be described below.

The largest single component of candle lantern 10 is a one-piece, translucent or transparent body 12 formed from a suitable heat-resistant plastic or glass material. Lantern body 12 is hollow to hold a candle and related structure described below, and is preferably (although not necessarily) cylindrical as illustrated. Lantern body 12 includes a set of holes 14 adjacent each open end 16. In its illustrated form lantern body 12 is a symmetrical cylinder, so that the designation of "upper" and "lower" ends is arbitrary depending on the lantern's orientation and the position of the candle inside the lantern.

Holes 14 permit set screws 18 to be inserted through lantern body 12 to lockingly engage a cup-shaped candle holder/heat shield 20 at each end. The outer ends 18*a* of set screws 18 are preferably formed to provide a suitable attachment point for wire base legs 22 (FIG. 1). Outer ends 18*a* are also sized to be easily finger-tightened without tools.

In the illustrated embodiment, each end of lantern body 12 is provided with a set of four holes 14 with four corresponding set screws 18. It will be understood by those skilled in the art, however, that more or fewer are possible although perhaps less desirable. Whatever number of holes and corresponding set screws provided at each end, the arrangement should be symmetrical.

Referring now to FIGS. 2–4, the internal structure of the candle lantern is shown in sectional detail. Lowermost cup 20 is positioned in the "lower" end of lantern body 12, held in place by set screws 18 threaded into collars 20*a*. Lowermost cup 20 is oriented with its open face upwardly (i.e., into the interior of lantern body 12) to support an ordinary candle 24 of known type in the interior of the lantern. In the illustrated embodiment of FIG. 2, cup 20 is sized to receive an ordinary "tea light" candle which may or may not be provided with its own disposable metal cup. When tea light type candles are used, they fit closely enough with cup 20 that their mating fit alone is sufficient to hold the candle securely in place.

However, in the event that tea light candles are unavailable, or that some different type of candle is used (as shown in solid lines in FIG. 2), holes 20*b* in cups 20 can be used in conjunction with the set screws 18 to lock the under-diameter candle in place, as follows: First, set screws 18 are unthreaded from the blind bores in collars 20*a* so that cup 20 can be rotated to bring holes 20*b* into alignment with holes 14 in lantern body 12. Set screws 18 can then be threaded completely through the sidewall of cup 20 until their ends come into contact with candle 24.

It will accordingly be understood that the complementary set screws 18, holes 14, blind bore collars 20*a*, and holes 20*b* can accommodate virtually any candle with a diameter equal to or less than the inner diameter of cup 20. If very small diameter candles are used, it may be necessary to lengthen set screws 18; this is a variable which can be adjusted by those skilled in the art depending on the type of candle which may be used. It is preferable to provide set screws of a length which will accommodate both tea light candles (when threaded into blind bore collars 20*a*) and undersized candles (when threaded through holes 20*b* into direct contact with the candle), although it is also possible to supply two sets of screws of different length for use with collars 20*a* and holes 20*b*, respectively. Cups 20 may additionally be provided with a small candle-engaging prong or barb 20*c* shown in phantom in FIG. 2 which digs into the base of the candle, especially to hold an undersized candle 24 in place in the cup until set screws 18 can be brought to bear on the candle.

As mentioned above, set screws 18 not only serve to secure cup 20 and candle 24 in the lantern body, but also provide a support and attachment point for wire base 22. It will be understood, however, that while the legs of base 22 provide a wider, more stable base for lantern 10, the flat-ended cylinder of lantern body 12 is self supporting on any reasonably flat surface, and can be used without base 22, if desired.

Figure 6:
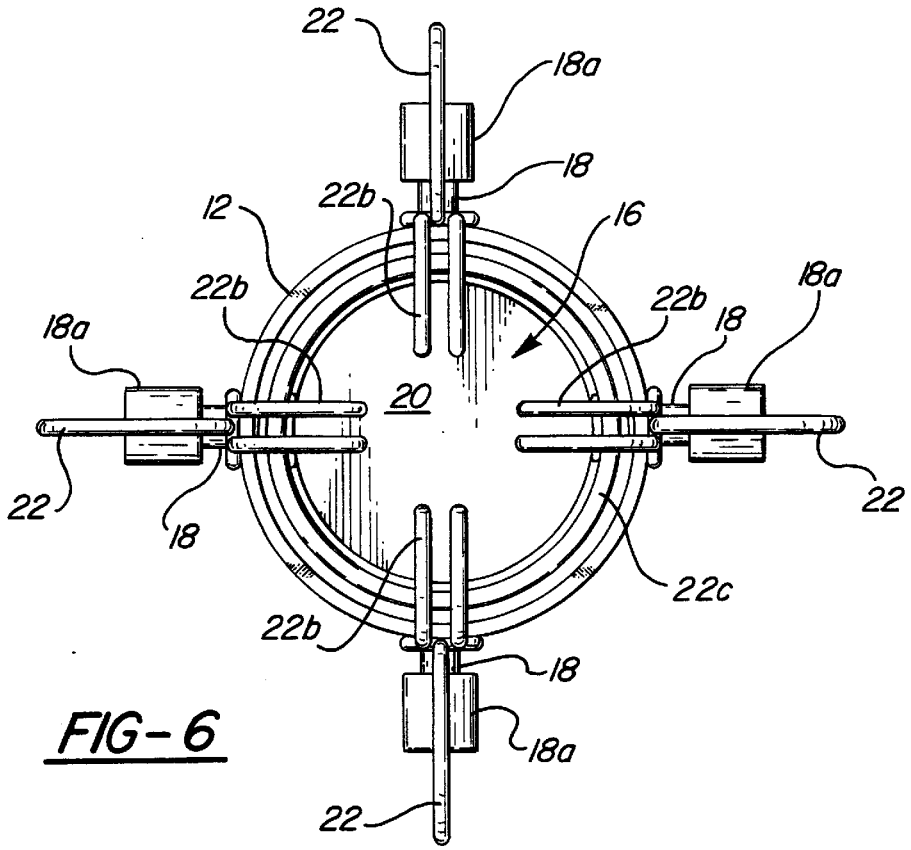

Although base 22 is optional, it is preferred, and performs additional functions beyond providing a stable, stand-up base for the lantern. As illustrated, base 22 is preferably formed from a metal wire, with closed loops 22*a* forming the "feet" and prongs 22*b* extending under cup 20 (best shown in FIG. 6) to keep the cup in the lantern until it can be locked in place with set screws 18. The individual legs or "feet" 22*a* are joined together as a unit by a ring 22*c*, for example soldered to prongs 22*b*. Ring 22*c* can also be sized to receive and locate the candle-holding cap 20, as shown in FIG. 2.

If the lantern is hung by bail handle 26, decorations can be hung from legs 22, especially if threaded through loops 22*a*. Alternately, legs 22 can be removed from the "lower" end of the lantern and secured to the "upper" end by set screws 18 in inverted fashion to provide an attachment point for a hanging support such as a cord or chain, thereby eliminating the need for a separate bail handle 26.

Referring now to the "upper" end of lantern 10 in FIG. 2, it is identical in structure to the lower end, with the addition of optional and removable bail handle 26 and shield 28. Cup 20 at the upper end of the lantern is identical to cup 20 at the lower end, and can be positioned facing upwardly as shown in FIG. 2, or can be inverted as desired. When a candle 24 is located in lower cup 20 inside the lantern, empty "upper" cup 20 acts as a heat and wind shield, as well as providing an attachment point for set screws 18 and optional bail handle 26 and shield 28. Uppermost cup 20 can also be used to support a candle on top of the lantern in the same manner that lower cup 20 supports candle 24. This allows the lantern to function as a candle stand if a different lighting effect is desired.

Bail handle 26 telescopes in and out of the lantern, limited in its upward motion by hooks or loops on its lower end which catch on set screws 18 and/or collars 20 as handle 26 is raised to its uppermost position (shown in broken lines).

Shield 28 is an optional piece which may be employed on top of upper cup 20, to provide additional heat shielding or to prevent the entry of rain out of cup 20 and the inside of the lanter. Any rain which manges to get into the lantern around shield 28 and cup 20 will fall between lower cup 20 and body 12, missing candle 24 and draining out the semi-open bottom end. Shield 28 is best shown in FIG. 4, provided with a number of slots 28*a* about its periphery through which slide the upright portions of bail handle 26. The portions of bail handle 26 in slots 28*a* prevent shield 28 from rotating. The crossbar on handle 26 prevents shield 28 from sliding off the handle.

The above-described structure provides a truly multi-functional, multipurpose candle lantern. The largely plastic or glass body 12 keeps the weight of the lantern to a minimum, making it suitable for back-packing. The all-plastic/glass body 12 emits light over nearly the entire surface of the lantern. Lantern body 12 can be made from materials of different colors, or with different levels of translucence, and is easily switched or replaced if broken or if a different lighting effect is desired. The base of the lantern, comprising lowermost cup 20, set screws 14 and legs 22, can be used alone, without body 12, as a candle stand. Set screws 18 engage either cup 20 or the candle 24 directly, and do not put any pressure on body 12. The lantern can be used as a free-standing lantern or a hanging lantern, as described above. The lantern can be used without a base 22, with one base 22 used as either a base or a hanging support, or can even be provided with a second base 22 at its upper end to provide a shade support. The lantern can be used as a lantern with a candle inside the body, or as a candle stand using the uppermost cup 20 as described above. Uppermost cup 20 can also provide an ashtray function when shield 28 is removed. The lantern can also be used with a light other than a candle, for example a flashlight or electric bulb in the lower cup. When the lantern is used as a candle stand, with the candle supported in the upper cup 20, an electric light can be provided in the interior on lower cup 20 to provide a lighted-stand effect. And, the lantern structure is totally symmetrical, with all parts being interchangeable for use at the upper or lower end of the lantern as desired for customizing or replacement purposes.

The foregoing illustrated embodiment represents a preferred example of my invention, and is not intended to limit the invention beyond the scope of the following claims, since reasonable variations and modifications to the exemplary set screws, base structure, candle holder/heat shields and lantern body disclosed above will lie within their scope.

I claim:

1. A candle lantern comprising:

a body comprising an open-ended tube of an at least translucent material;

a removable cup adapted to be inserted into the open ended tube as a candle holder;

a first set of holes in a lower end of the tube, and a first set of set screws adapted to be inserted through the holes to engage and secure the cup;

a second set of holes in an upper end of the tube, adapted to receive the set screws to engage and secure the removable cup at the upper end.

2. A candle lantern as defined in claim 1, further including a second set of set screws and a second removable cup, the second set of set screws being inserted through the second set of holes in the upper end of the tube to secure the second removable cup in the upper end of the tube above the first removable cup in the lower end of the tube.

3. A candle lantern as defined in claim 1, further including a base comprising legs adapted to be secured to an end of the lantern tube by the set screws.

4. The candle lantern of claim 3, wherein the base comprises legs having end loop portions.

5. The candle lantern of claim 3, wherein the base comprises legs curved upwardly to function as shade-retaining portions.

6. The candle lantern of claim 1, wherein the removable cup includes a plurality of blind apertures on its exterior adapted to receive the set screws to bear against the cup, and a plurality of holes through the cup portion adapted to receive the set screws therethrough to bear against a candle in the cup.

7. The candle lantern of claim 2, further including a retractable bail handle mounted in the upper end of the lantern and retained by the set screws and cup in the upper end of the lantern.

8. The candle lantern of claim 7, further including a shield located in the upper end of the lantern on top of the second cup and retained by the bail handle.

9. The candle lantern of claim 2, wherein the first and second cups are identical.

10. The candle lantern of claim 1, wherein the cup is adapted to be mounted in either end of the tube in both upright and inverted positions.

11. A candle lantern comprising:

a body comprising an open-ended tube of a material which is at least translucent;

two removable candle-holding cups adapted to be mounted in the upper and lower ends of the tube, respectively, the cups being interchangeable;

means for removably securing the cups in the tube;

a removable base adapted to be mounted at either end of the tube by the means for removably securing the cups in the tube.

12. A candle lantern comprising:

a body comprising an open-ended tube of a material which is at least translucent;

two removable candle-holding cups adapted to be mounted in the upper and lower ends of the tube, respectively, the cups being interchangeable and adapted to be mounted in both upright and inverted positions in the tube;

a first set of holes in the lower end of the tube for receiving set screws therethrough, and a second set of holes in an upper end of the tube for receiving set screws therethrough, and lower and upper sets of set screws adapted to be inserted through the holes to engage and secure the removable candle-holding cups in the tube;

a base comprising secured to the tube by the set screws at one end;

a retractable bail handle mounted in the upper end of the tube and retained by the set screws and cup portion in the upper end of the lantern.

* * * * *